United States Patent [19]

Olsson

[11] Patent Number: 4,902,245

[45] Date of Patent: Feb. 20, 1990

[54] METHODS AND APPARATUS FOR TERMINATING AND INTERCONNECTING FLAT POWER CABLES

[75] Inventor: Billy E. Olsson, New Cumberland, Pa.

[73] Assignee: AMP Incorporated, Harrisburg, Pa.

[21] Appl. No.: 341,526

[22] Filed: Apr. 21, 1989

[51] Int. Cl.[4] ..... H01R 17/06
[52] U.S. Cl. ..... 439/492
[58] Field of Search ..... 439/492–499

[56] References Cited

U.S. PATENT DOCUMENTS

| | | | |
|---|---|---|---|
| Re. 31,336 | 8/1983 | Weinmann et al. | 29/868 |
| 521,825 | 6/1894 | Shipe . | |
| 2,020,408 | 11/1935 | Fruth | 175/315 |
| 2,080,750 | 5/1937 | Thompson | 29/149.5 |
| 2,981,918 | 4/1961 | Fluck et al. | 439/492 |
| 3,138,658 | 6/1964 | Weimer, Jr. | 174/94 |
| 3,188,601 | 6/1965 | De Tar | 439/492 |
| 3,193,921 | 7/1965 | Kahn | 29/509 |
| 3,197,729 | 7/1965 | Sarazen | 339/97 |
| 3,247,316 | 4/1966 | Weimer, Jr. | 174/94 |
| 3,701,964 | 10/1972 | Cronin | 439/492 |
| 3,752,901 | 8/1973 | Kuo | 174/84 C |
| 3,881,796 | 5/1975 | Saunders | 339/97 C |
| 4,008,941 | 2/1977 | Smith | 439/578 |
| 4,015,328 | 4/1977 | McDonough | 29/625 |
| 4,059,897 | 11/1977 | Marquis | 29/432.1 |
| 4,241,498 | 12/1980 | Brandeau | 29/861 |
| 4,248,493 | 2/1981 | Kuo | 339/97 R |
| 4,249,304 | 2/1981 | Weinmann et al. | 29/872 |
| 4,357,065 | 11/1982 | Kam et al. | 339/97 R |
| 4,490,904 | 1/1985 | Moyher | 29/864 |
| 4,620,758 | 11/1986 | Frola | 339/22 B |
| 4,821,409 | 4/1989 | Nager, Jr. | 29/747 |
| 4,834,673 | 5/1989 | Beinhaur et al. | 439/422 |

FOREIGN PATENT DOCUMENTS 48-30780 4/1973 Japan .

OTHER PUBLICATIONS

AMP Data Sheet 74–279 issued 7–84; "AMP Termi--Foil Terminals and Splices;" AMP Incorporated, Harrisburg, PA.

*Primary Examiner*—Joseph H. McGlynn
*Attorney, Agent, or Firm*—Anton P. Ness

[57] ABSTRACT

A terminal is terminated onto the end of a flat power cable by punching a plurality of holes through an end section of the cable and its conductor means, placing a plate section of the terminal over or under the punched cable end section so that apertures through the plate section are vertically aligned with the punched holes, solid copper inserts are placed in the aligned hole arrangements, and the insert ends protrude above and below the top and bottom surfaces of the stacked package and are staked by punches to enlarge the insert ends into heads securing the package together and enlarging the diameter of the inserts to tightly fill the holes and apertures forming a plurality of gas-tight electrical connections. A pair of terminals is similarly securable to respective conductors of a dual conductor cable. Support members can be formed of strips of cable cut from the end thereof and having holes punched therein, which are placed along the top and bottom of the stacked package prior to staking the insert ends. A tap cable can be interconnected to a main cable, either in a parallel tap or a T-tap, or two cables spliced together, by similarly punching holes through both cables and inserting inserts therethrough and staking them, without using a terminal. Apparatus containing the punches includes a series of cams in the lower die assembly to move both upper and lower punches simultaneously against the insert ends by a single downstroke of the upper die assembly.

42 Claims, 9 Drawing Sheets

22
22
60
24
62
14
60
12
18
20
66
64
68
20
74
86
90
80
76
88
78
90
26
72
60
84
82
70

METHODS AND APPARATUS FOR TERMINATING AND INTERCONNECTING FLAT POWER CABLES

FIELD OF THE INVENTION

The invention relates to electrical terminals and connections and more particularly to the termination and interconnection of flat power cables.

BACKGROUND OF THE INVENTION

U.S. patent applications Ser. Nos. 07/298,259 and 07/193,852 disclose a transition adapter which is crimped onto a flat power cable by penetrating the insulation covering the cable's conductor and also shearing through the conductor at a plurality of locations. The cable is of the type entering commercial use for transmitting electrical power of for example 75 amperes nominal, and includes a flat conductor one inch wide and about 0.020 inches thick with an extruded insulated coating of about 0.004 to 0.008 inches thick over each surface with the cable having a total thickness averaging about 0.034 inches.

The transition adapter of Ser. Nos. 07/298,259 and 07/193,852 is stamped and formed of sheet metal and in one embodiment includes a pair of opposing plate sections disposed along respective major surfaces of the cable and including opposing terminating regions extending transversely across the cable. Each terminating region includes a transverse array of alternating shearing wave shapes and relief recesses of equal width, opposed by a corresponding array of alternating relief recesses and shearing wave shapes respectively of the opposing plate section. The relief recesses are defined by arcuate projections extending away from the cable-proximate side, and the shearing wave shapes extend outwardly from the cable-proximate side and toward relief recesses in the opposed plate section. Each wave shape has a transverse crest between parallel side edges, and the side edges of the corresponding relief recess are associated with the wave side edges to comprise pairs of shearing edges, preferably with zero clearance. When the plate sections are pressed against a cable section disposed therebetween the crests of the wave shapes initiate cable shearing by their axially oriented side edges cutting through the cable insulation and into and through the metal conductor. The wave shapes extrude the sheared cable strips outwardly into the opposing relief recesses as the shears propagate axially along the cable for limited distances, forming a series of interlocking wave joints with the cable while exposing newly sheared edges of the cable conductor for electrical connection therewith.

Fastened to the outwardly facing surface of the plate sections of the above transition adapter at the terminating regions are respective inserts of low resistance copper, and the inserts have adapter-facing surfaces conforming closely to the shaped outer surface of the terminating region, with alternating wave shapes and apertures disposed outwardly of and along the adapter wave shapes and relief recesses. Upon termination the wave joints are within the insert apertures, and the sheared edges of the adjacent conductor strips and of the adapter wave shapes which formed the sheared strips are adjacent to side surfaces of the copper insert apertures. After a first staking step axially splits the wave joints exposed in the insert apertures which creates spring fingers storing energy in the wave joints, a second staking step deforms the insert between the sheared strips to deform the copper against the sheared conductor and wave shape edges, forming gas-tight, heat and vibration resistant electrical connections with the cable conductor and with the transition adapter, so that the inserts are electrically in series at a plurality of locations between the conductor and the adapter.

A contact section is integrally included on the above transition adapter enabling mating with corresponding contact means of an electrical connector, or a bus bar, or a power supply terminal, for example, and can include a plurality of contact sections to distribute the power to a corresponding plurality of contact means if desired. A housing or other dielectric covering can be placed around the termination as desired.

Also entering commercial acceptance is a dual conductor flat cable, wherein a pair of parallel spaced coplanar flat conductor strips having insulation extruded therearound define power and return paths for electrical power transmission. One method has been devised as disclosed in U. S. Pat. No. 4,241,498 which involves a member associated with one of the two conductors having upper and lower sections joined at a tab. The upper and lower sections are brought along the upper and lower surfaces of the conductor from the side of the cable so that the tab is disposed laterally of the cable. The upper and lower sections have semicylindrical metallic jaws having alternating grooves and lands with the grooves of one jaw adapted to receive thereinto the lands of the opposing jaw when the upper and lower sections are pressed against the conductor. The lands shear strips of the conductor and extrude the sheared strips into the opposing grooves, in a punch and die process. After termination the sheared conductor edges are disposed adjacent sides of the grooves of the semicylindrical jaws to form electrical connections therewith. The tab extends laterally from the cable and is exposed for electrical engagement therewith by another electrical article. The other conductor may be similarly terminated at a nearby location. In another method for terminating multiconductor flat cable for undercarpet use, an adapter has a plurality of terminals for respective conductors of the cable joined by a strip of dielectric polymeric material, each terminal having an array of upstanding ribs punched out of the plane of the terminal and having vertical sheared edges. The adapter is to be disposed across the cable and the ribs will extend axially along the cable. The cable is prepared by punching therethrough an array of slots corresponding to the ribs, and each slot has a width identical to a rib width. The strip of terminals is placed across the cable so that the ribs extend through the slots and extend beyond the far cable surface far enough so that a tough metal foil tab or strip may be placed under each rib array along the far cable surface. The ribs are then flattened back into the slots, and the foil is thereby pressfitted or wedged between the rib edges and the sheared conductor edges defining the slots forming electrical connections between the terminals and the respective conductors. Solder is placed in the voids of the terminals left from forming the ribs, which also may contribute to a good electrical connection when reflowed to join the terminal to adjacent surfaces of the metal foil tab portions pressed into the cable slots.

It is desired to provide a means and method for terminating single and dual conductor flat power cable.

It is also desired that such termination be relatively simple and provide for assured electrical connections which remain gas-tight and heat and vibration resistant over time.

It is further desired to provide a means and method for electrically connecting a single or dual dual conductor tap cable to a single or dual conductor main cable, or splicing two cables.

SUMMARY OF THE INVENTION

The present invention provides for terminating a transition adapter to an end section of flat power cable of either the single conductor or dual conductor type.

The adapter at least after termination comprises two electrically separate members each terminated to a respective one of the conductors and having a respective contact section extending outwardly to be mated with a corresponding respective contact section of a mating electrical article such as a connector or a bussing system. The transition adapter at least prior to termination, preferably is an integral member to facilitate handling and has a pair of adapter sections each having a plate section and a contact section forwardly thereof, with each plate section including a pair of apertures extending therethrough of a selected diameter. The adapter sections prior to termination may be joined by a severable link forwardly of the plate sections and between the contact sections, to facilitate handling. The pair of adapter sections may be retained joined together if terminated to a single conductor flat power cable.

The cable is prepared by punching a pair of holes through each of the conductors, aligned transversely across the cable, with each of the holes having a diameter equal to the diameter of the apertures through the adapter plate sections. The transition adapter is placed or stacked beneath (or atop) the cable end portion with the array of apertures aligned with the array of holes punched through the cable, and with the contact sections extending outwardly from the end of the cable. Solid cylindrical inserts of low resistance copper are placed within the respective aligned holes and apertures. The inserts have diameters slightly smaller than the diameters of the holes and apertures, and the inserts are longer than the combined thicknesses of the cable and the transition adapter so that ends extend above and below the outwardly facing surfaces of the adapter and cable.

After the inserts are placed in position loosely within the respective hole and aperture arrangements through the stacked package atop a support surface, the exposed outwardly facing ends of the inserts are simultaneously staked to deform the metal, enlarging the insert diameters within the holes against the edges of the adapter plate sections defining the apertures and the exposed sheared edges of the conductors defining the punched holes, forming gas-tight electrical connections of the inserts with the respective plate sections and the respective conductors. The outwardly facing ends of the inserts are deformingly enlarged by the staking to expand laterally along the outer surfaces adjacent the periphery of the apertures and holes of the plate sections and the cable respectively, as in riveting, to form assured mechanical connections of the inserts and plate sections to the cable. The severable link joining the adapter sections is then severed to electrically separate the respective sections into separate terminals.

The assembling of the cable and transition adapter into a stacked package and placing the inserts into the respective hole arrangements may preferably be done in an assembly location in a nest of a transfer plate after which the transfer plate is moved into position to place the stacked assembly within a punch region between opposing upper and lower die assemblies of a reciprocal ram press apparatus, with end faces of the inserts exposed to be staked. Punches are disposed in vertical passageways in the upper and lower die assemblies defining opposing upper and lower arrays in the punch region of the apparatus, and the inserts will drop slightly into entrances to the lower punch passageways to rest atop the respective lower punches. The upper die assembly includes a pressure plate which clamps the stacked package around the protruding insert ends against the lower die assembly upper surface during the downward stroke and prior to the punches striking the inserts. The apparatus may have another punch and die arrangement to simultaneously sever the severable link between the adapter sections.

The lower die assembly of the apparatus includes a series of cams so that the downward stroke of the upper die assembly imparts force which is transmitted by the cams to the lower punches causing the lower punches to be forced upwardly against the inserts simultaneously with the upper punches striking the top ends of the inserts. Each punch includes a central staking boss surrounded by an annular recess with a rounded bottom; the staking bosses of each pair of punches deform the insert ends outwardly and the annular recesses shape the insert ends into a pair of enlarged heads, rivet-fashion, forming a joint; the pair of punches also enlarge the insert's diameter within the cable hole and adapter section aperture forming a gas-tight interconnection therebetween.

It may be preferable to use narrow strips of the cable which are cut from the end thereof, as support members for the termination. Two strips of cable are cut from the end of the cable, and pairs of holes are punched in the two strips in respective transverse rows; the holes may all be punched before cutting the strips from the cable for convenience. One of the support strips is placed below the transition adapter with its holes aligned with the adapter apertures, and the other is placed above the cable with its holes aligned with the cable holes. The inserts are then placed into the aligned holes and apertures of the cable, the adapter, and the two support strips and are dimensioned to be long enough to extend outwardly from the outwardly facing surfaces of the support strips.

In one method for establishing a tap connection between a main power cable and a tap cable, where the tap cable at least at the termination site is in a plane parallel to the main cable so oriented that its conductors extend parallel to the conductors of the main cable at the termination site, pairs of holes are punched in the main cable in a row transverse thereto. Two strips of cable are cut from the end of the tap cable to become support members, and pairs of holes are punched in the two strips and in the end of the tap cable in respective transverse rows; the holes may all be punched before cutting the strips from the tap cable for convenience. The end of the tap cable is placed against the main cable at the termination site with the punched holes vertically aligned, and the two support strips are placed above and below the main and tap cables with their pairs of holes aligned vertically with the holes of the main and tap cables. Solid cylindrical inserts are placed through the four vertical hole arrangements with ends extending beyond the outwardly facing surfaces of the support strips. The insert end faces are staked to deform the metal outwardly against the exposed conductor edges to define gas-tight, heat and vibration resistant electrical connections of the pairs of inserts with the respective conductors of the main and tap cables, and the insert ends are deformingly enlarged against the outwardly facing surfaces of the support strips. The method can also connect a single conductor tap cable to a single conductor main cable. A dielectric housing may be placed therearound providing insulation and cable strain relief.

A similar method may be used to splice the overlapping ends of two such cables. Two spaced rows of pairs of holes may preferably be formed, and the support strips cut from one of the cables are square or rectangular to be disposed to cover the termination sit including the two spaced rows of pairs of holes, and the support members dimensioned appropriately.

In a second method for establishing a tap connection between a main power cable and a tap cable, where the tap cable in a plane parallel to the main cable but is so oriented that its conductors extend perpendicular to the conductors of the main cable at the termination site (a T shape), a pair of holes a selected distance apart is punched through each conductor of the main cable in two axially offset transverse rows where the offset between the two rows is equal to the distance between the centerlines of the conductors of the tap cable. Two square strips of cable will be cut from the end of the tap cable to become support members, and pairs of holes are punched in the two support strips and in the end of the tap cable in respective axially oriented rows along the centerline of the respective conductors, at axially offset locations. The offset of the points midway between the two holes of each pair is equal to the distance between the centerlines of the conductors of the main cable. As in the methods of preparing the support members in the other examples, the holes may all be punched before cutting the strips from the tap cable for convenience. The end of the tap cable is placed against the main cable at the termination site to extend in a parallel plane perpendicularly from the side of the main cable with the array of punched holes vertically aligned, and the two support strips are placed above and below the main and tap cables with their pairs of holes aligned vertically with the holes of the main and tap cables. Solid cylindrical inserts are placed through the four vertical hole arrangements with ends extending beyond the outwardly facing surfaces of the support strips. The insert end faces ar staked to deform the metal outwardly against the exposed conductor edges to define gas-tight, heat and vibration resistant electrical connections of the pairs o inserts with the respective conductors of the main and tap cables, and the insert ends are deformingly enlarged against the outwardly facing surfaces of the support strips. A dielectric housing may be placed therearound providing insulation and cable strain relief.

It is an objective of the present invention to provide a method of terminating a terminal or pair of terminals to flat power cable.

It is also an objective to provide a method for terminating a pair of terminals to respective conductors of a dual conductor flat cable for transmitting electrical power.

It is a further objective to provide a quick, economical termination of single or dual conductor flat power cable, where the termination is mechanically and electrically reliable, gas-tight and heat and vibration resistant.

It is another objective to provide a method for establishing an end splice connection of two cables which is quick, economical and reliable, and a tap connection of a tap cable to a main cable, both for a parallel tap and a 'T' tap.

It is still another objective of the present invention to provide apparatus for terminating or interconnecting single or dual conductor flat power cables.

Embodiments of the present invention will now be described with reference to the accompanying Figures.

Figures 1, 1A:
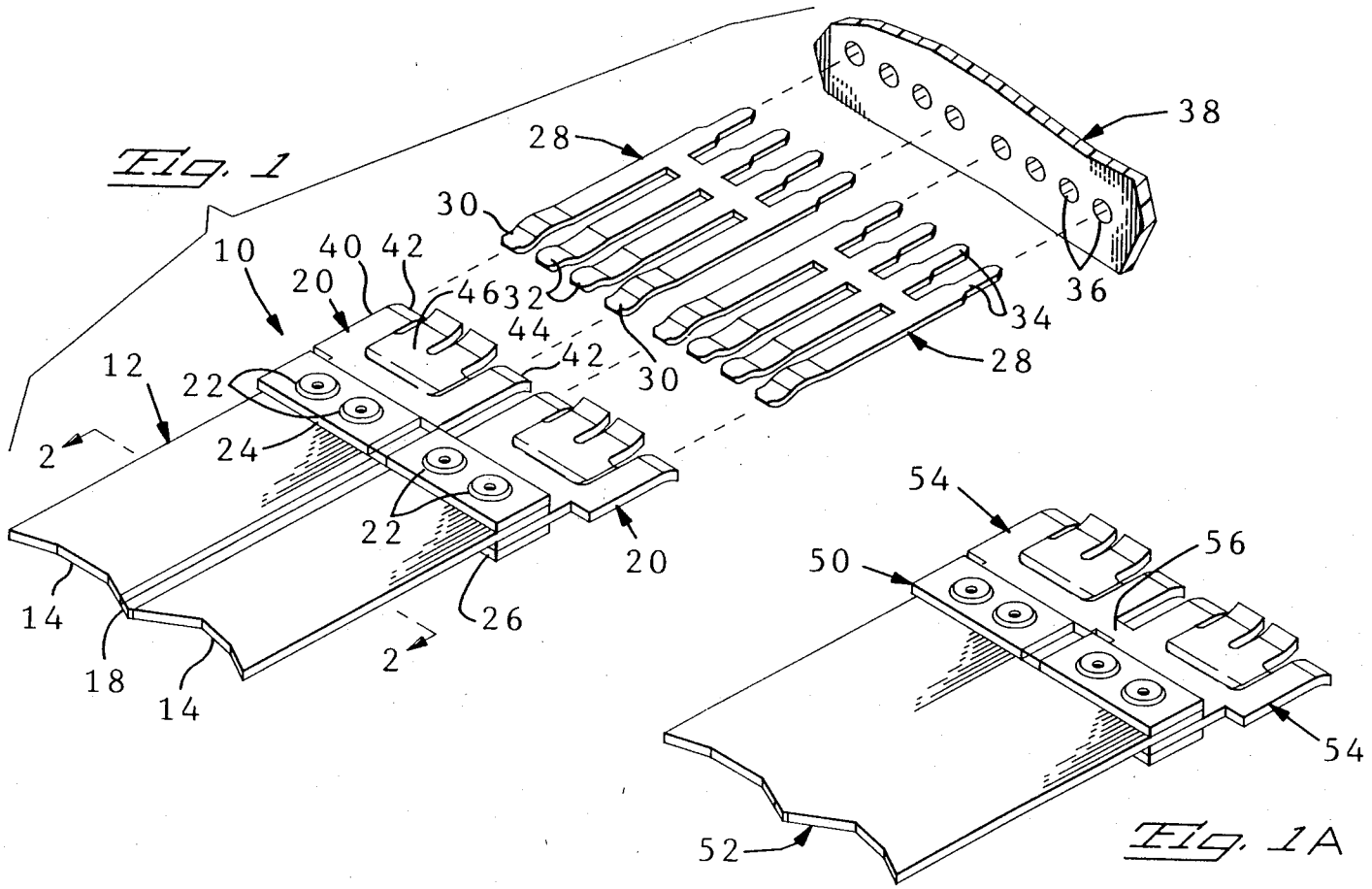
FIG. 1 is a perspective view of a transition adapter terminated to the end of a dual conductor flat cable, having two separate sections matable with corresponding separate terminal members shown having an array of posts to establish electrical connections with plated through-holes of a printed circuit board.
Figure 2:
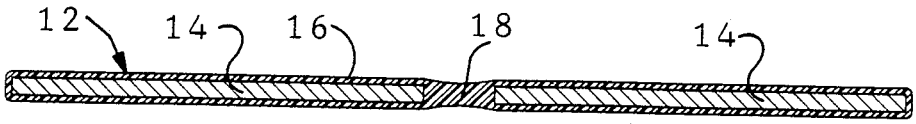
Figure 3:
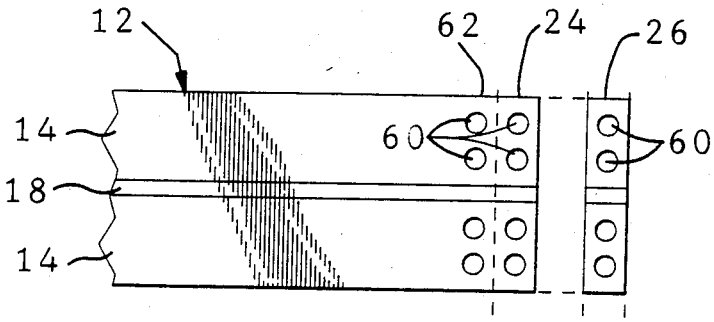
Figure 5:
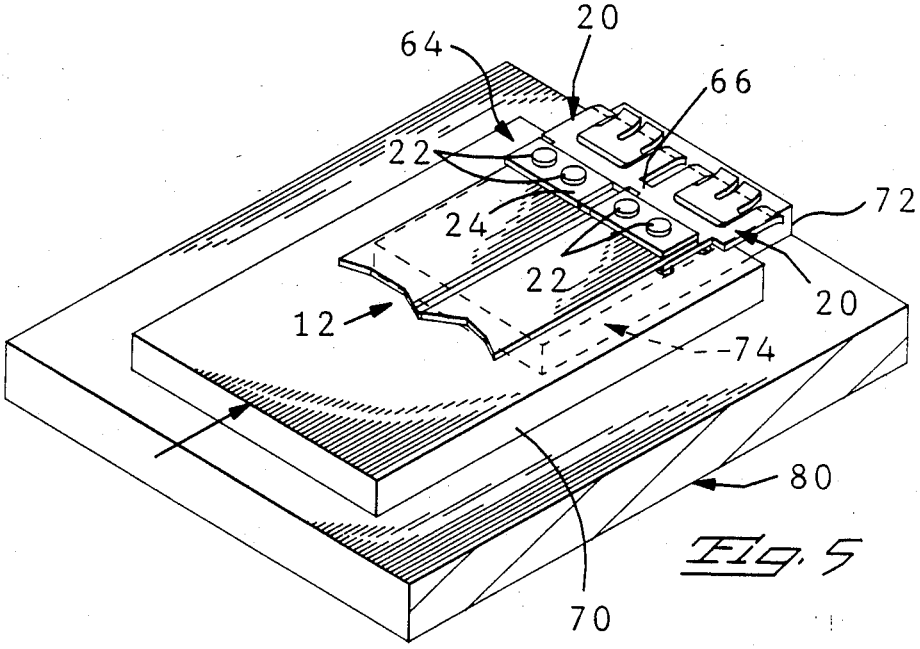
Figure 4:
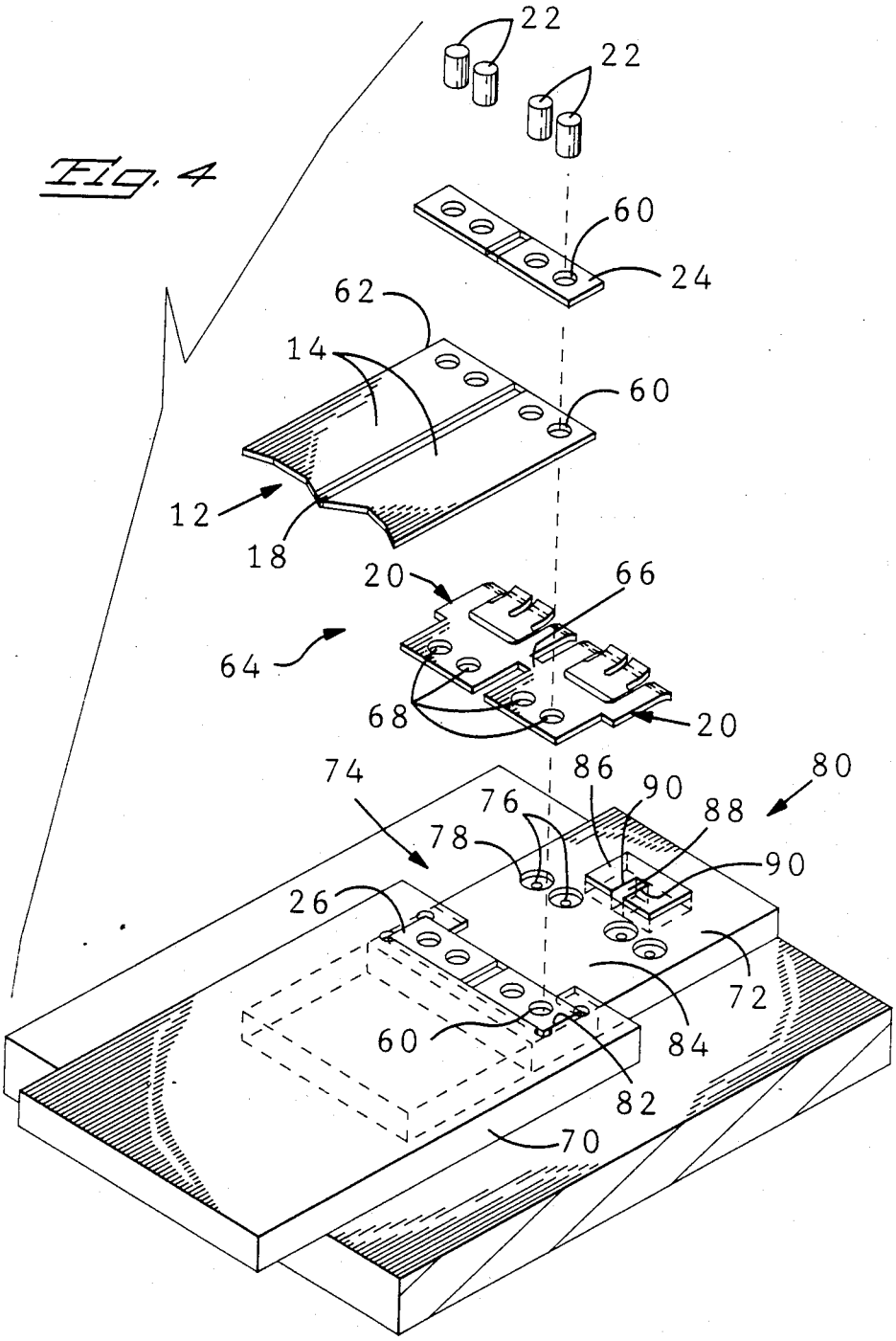
Figure 6:
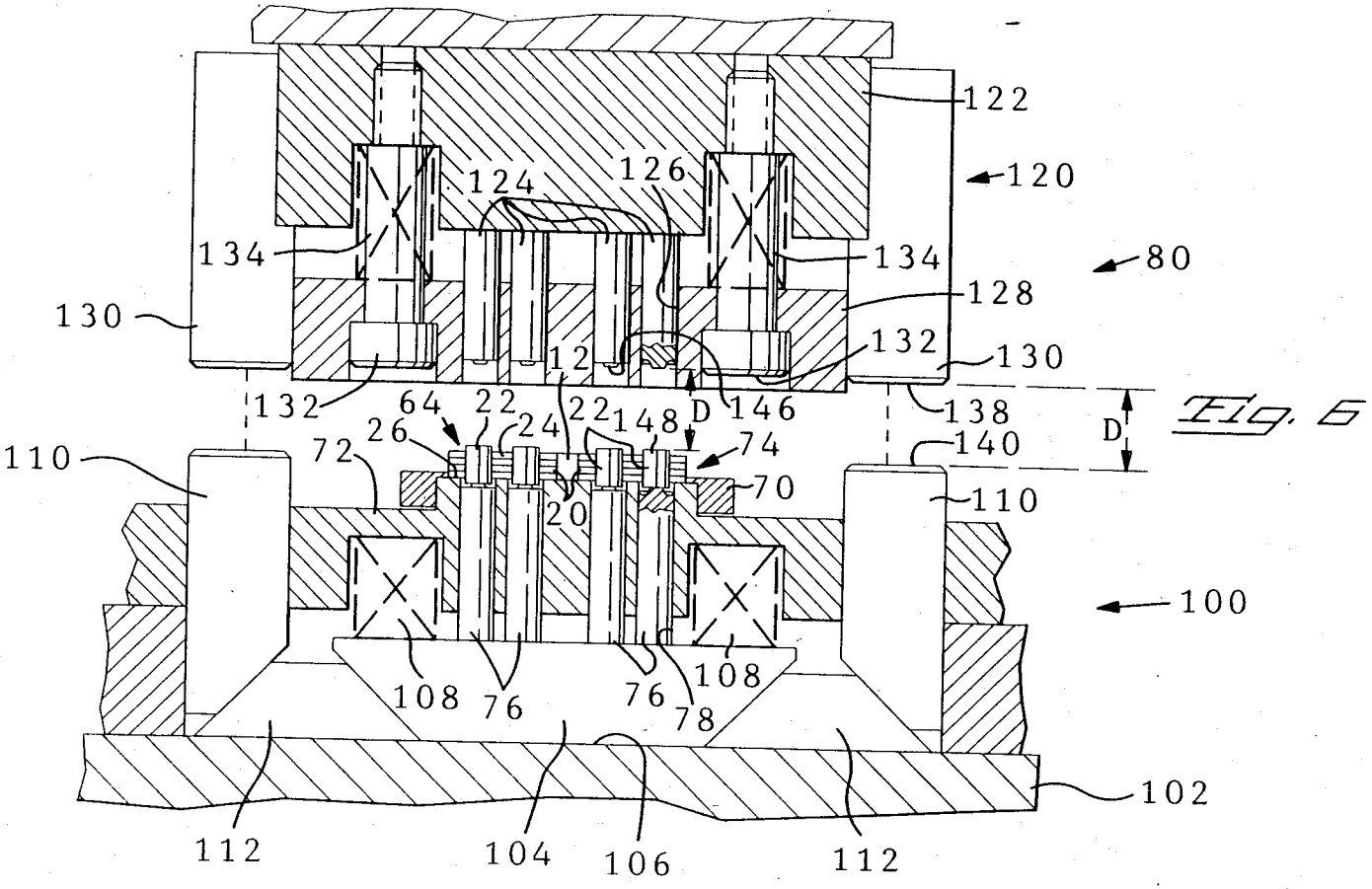
Figure 7A:
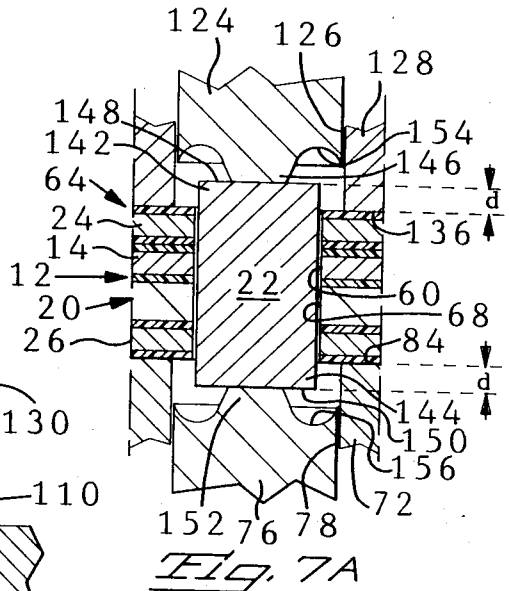
Figure 7:
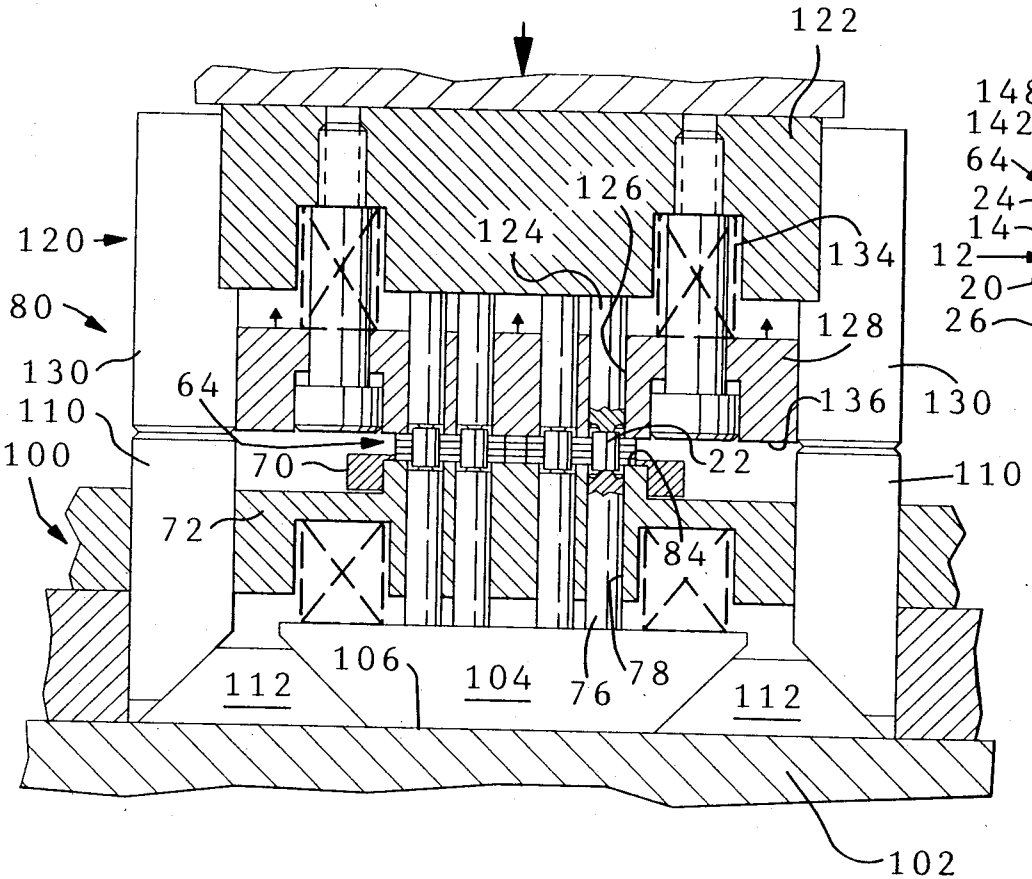
Figures 8, 8A:
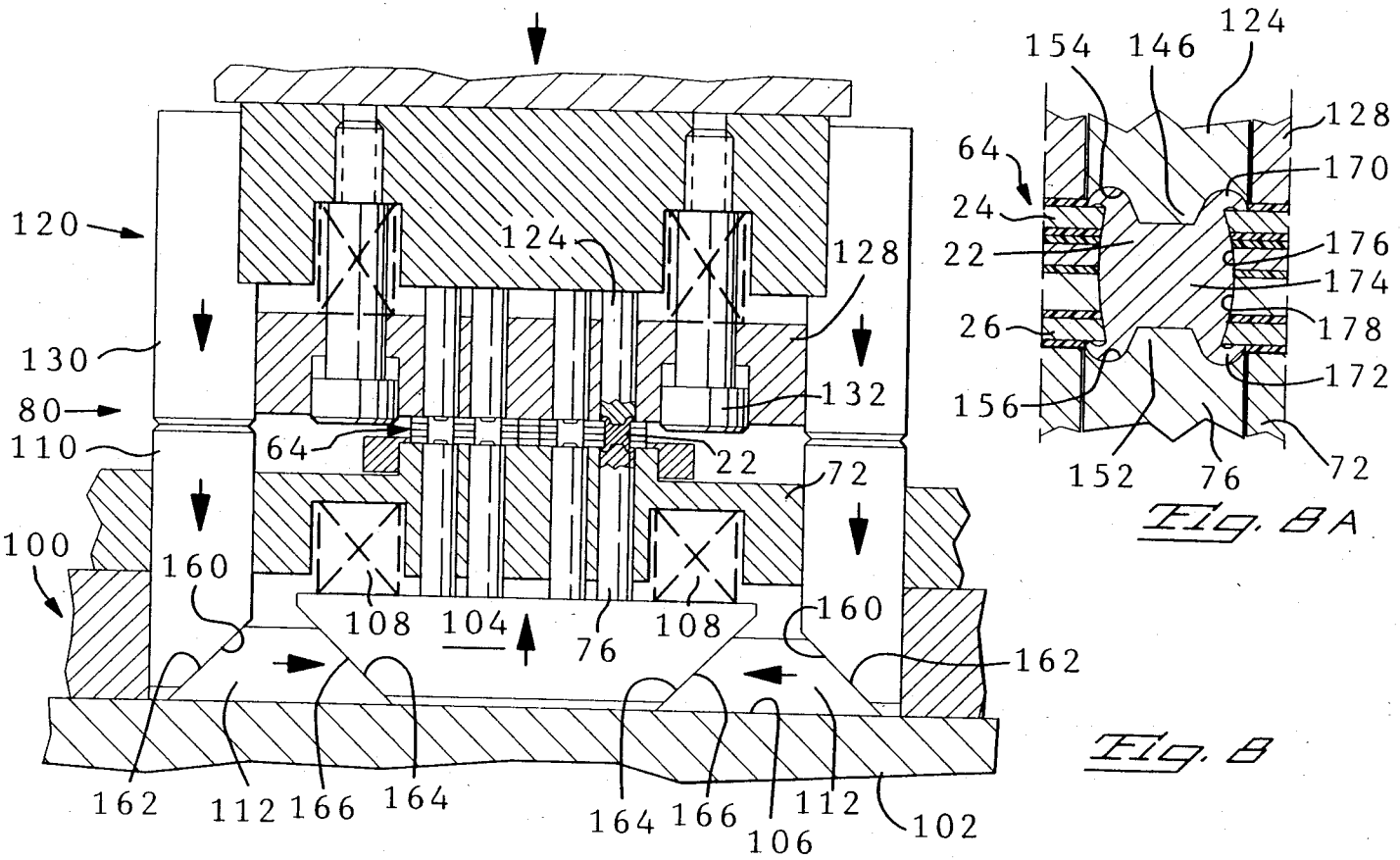
Figure 9:
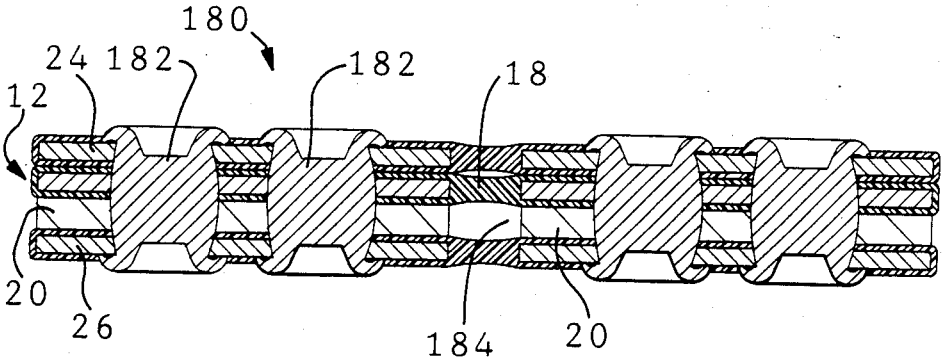
Figure 10:
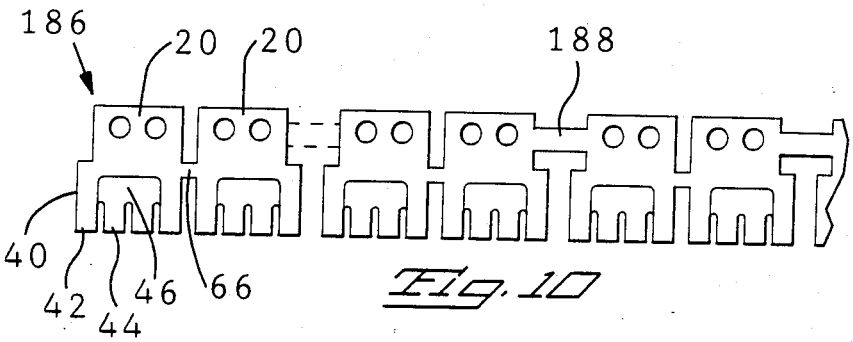
Figure 11:
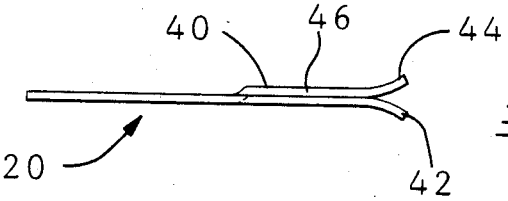
Figure 12:
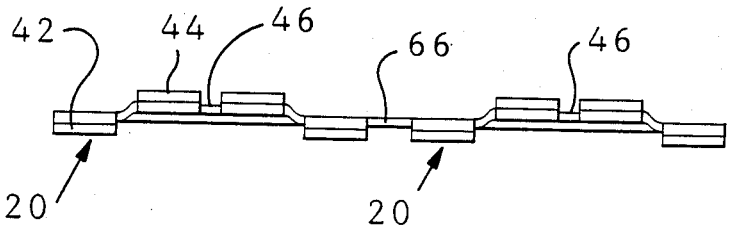
Figure 13:
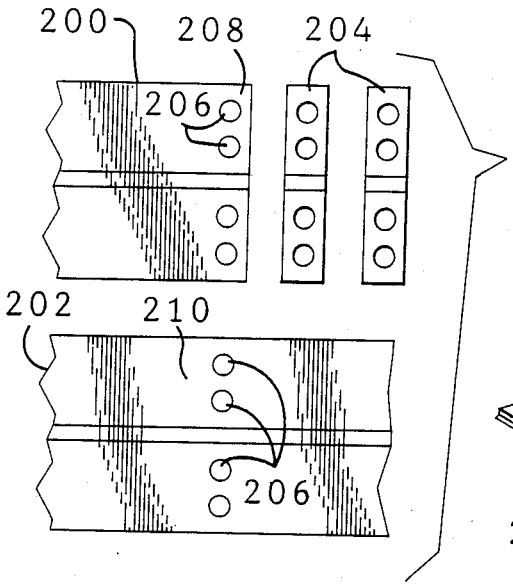
Figure 14:
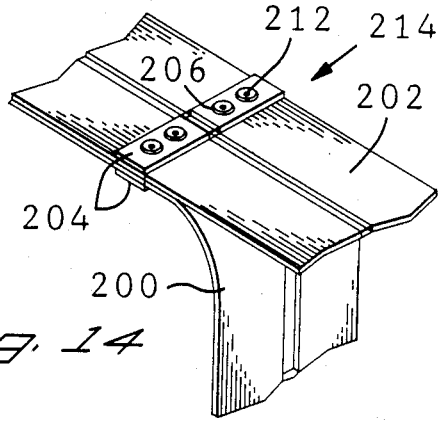
Figure 15:
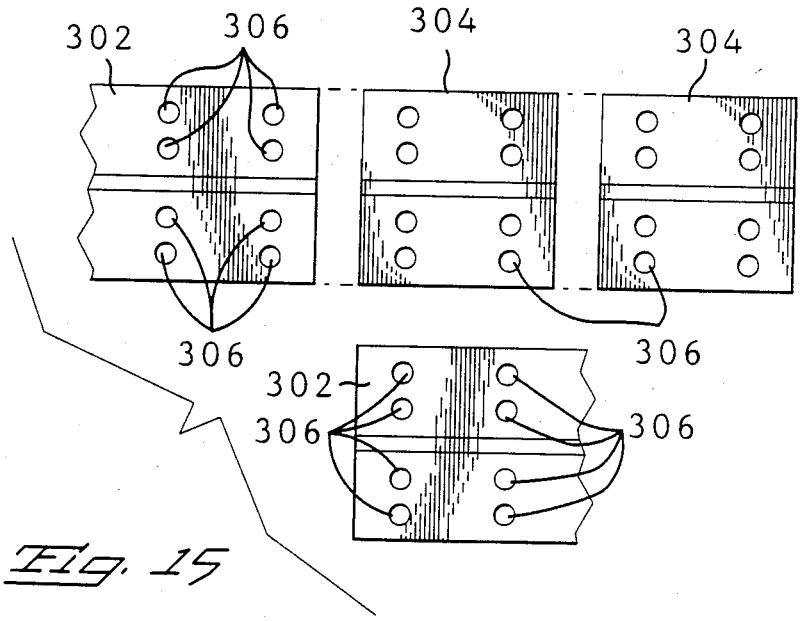
Figure 16:
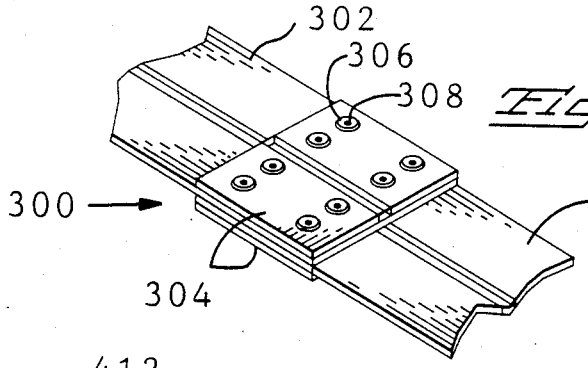
Figure 17:
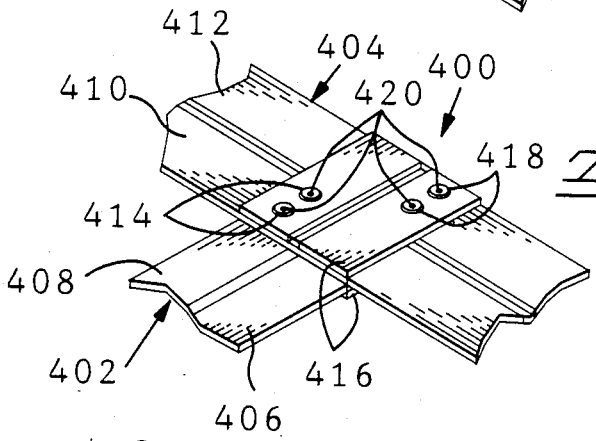
Figure 18:
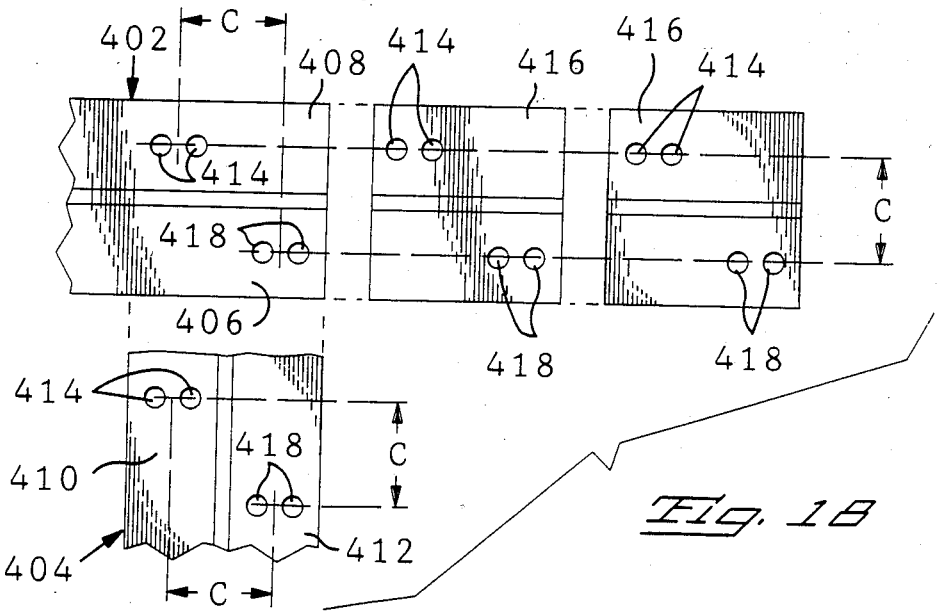

FIG. IA is a perspective view similar to the transition adapter of FIG. 1 terminated to a single conductor flat power cable;

FIG. 2 is a cross-section of the dual conductor flat cable;

FIG. 3 is a plan view of a dual conductor flat cable showing support strips being cut therefrom to be used in the termination, with arrays of hole pairs punched in the two conductors of the cable and in the support strips;

FIG. 4 is a perspective view showing the assembling of the prepared cable end, the transition adapter, the support strips, and the inserts in exploded relationship, being assembled onto a transfer plate of a termination apparatus, and also showing the top of the lower die assembly;

FIG. 5 is a perspective view of the termination assembly in position atop the lower die assembly of the terminating apparatus, ready to be terminated;

FIG. 6 is a cross-sectional view of the terminating apparatus having an upper die assembly and a lower die assembly, with the cable assembly in position therebetween to be terminated;

FIG. 7 is a cross-sectional view similar to FIG. 6 with the upper die assembly moved to initially engage the cable assembly;

FIG. 7A is an enlarged cross-sectional view showing upper and lower punches in the upper and lower die assemblies engaging an insert of the cable assembly;

FIG. 8 is a cross-sectional view similar to FIGS. 6 and 7, with the upper and lower punches having deformed the inserts and formed the termination of the transition adapter to the cable;

FIG. 8A is an enlarged cross-sectional view similar to FIG. 7A showing an insert staked by the upper and lower punches;

FIG. 9 is a cross-section of the termination showing the staked inserts disposed across the cable and transition adapter sections;

FIG. 10 is a plan view of a continuous strip of transition adapters;

FIGS. 11 and 12 are side and front views of the transition adapter showing one kind of contact section;

FIGS. 13 and 14 show cable preparation and a resulting termination of a parallel tap cable and a main cable;

FIGS. 15 and 16 show cable preparation and a resulting splice termination of ends of two main cables; and FIGS. 17 and 18 show cable preparation and a resulting termination of a tap cable to a main cable at a T-tap.

DETAILED DESCRIPTION OF THE PREFERRED EMBODIMENTS

FIG. 1 illustrates a termination 10 of a dual conductor flat power cable 12, wherein an adapter section 20 is terminated to a respective one of the two conductors 14. An insulative coating 16 is extruded around the two conductors and therebetween at medial region 18, best seen in FIG. 2. Adapter sections 20 are terminated to cable 12 by means of pairs of inserts 22 extending through apertures in the adapter sections and holes punched through the cable, as well as through upper and lower support members 24,26 which are strips of cable 12 cut therefrom, with the inserts then staked. Also shown in FIG. 1 is a pair of terminals 28 matable with respective adapter sections 20, shown having spring arm contact sections 30,32 and arrays of posts 34 insertable into corresponding arrays of plated through-holes 36 of a printed circuit board 38.

Adapter sections 20 may have a variety of types of contact sections thereon, and in FIG. 1 contact sections 40 are shown having arrays of splines 42,44 angled downwardly and upwardly matable with corresponding spring arms 30,32 of terminals 28 and adapted to deflect the corresponding spring arms upwardly and downwardly respectively upon mating. Central regions 46 of contact sections 40 containing upwardly angled splines 44 are shown offset upwardly a slight amount from the plane of the adapter section, which will be discussed with reference to FIGS. 11 and 12. The pairs of adapter sections 20 and terminals 28 are preferably disposed within housings of dielectric material (not shown).

As illustrated by termination 50 in FIG. IA, the same termination method and adapter sections may optionally be used with single conductor flat power cable 52 in which adapter sections 54 may remain joined together by a link 56 which was also initially present joining adapter sections 20 of FIG. 1 to facilitate handling prior to termination to cable 12.

In FIG. 3 dual conductor flat power cable 12 is being prepared for termination by severing strips from the end thereof which will comprise upper and lower support members 24,26 of the termination. Pairs of holes 60 are punched in all of support members 24,26 and the end portion 62 of cable 12, through which inserts 22 will be placed and then staked. Sharp-edged punches (not shown) cut the insulation during punching which prevents portions of the insulation from extrusion over the sheared conductor edges, thus providing clean cut exposed thicknesses of metal which maximizes the area of contact between the conductor and the insert upon termination. Support members 24,26 may be comprised of other planar items if desired, but mostly conveniently can simply be strips of cable 12.

In FIG. 4 is shown the assembly 64 of the prepared cable end portion 62, adapter sections 20 joined by link 66, upper and lower support members 24,26 and inserts 22. Adapter sections 20 are shown having apertures 68 therethrough located to correspond with holes 60 punched in cable end portion 62 and upper and lower support members 24,26. The assembling is being performed on a transfer plate 70, and transfer plate 70 is profiled to be slidable forwardly over die block 72 to move assembly 64 into the punch region 74 wherein a plurality of lower coining punches 76 are disposed within respective passageways 78. Transfer plate 70 and die block 72 are portions of termination apparatus 80. Lower support member 26 is shown disposed and located within nest 82 and upon a portion of the top surface 84 of die block 72. Die block 72 includes a die insert 86 of hardened steel forwardly of punch region 74, having a cavity 88 adapted to receive a punch (not shown) of the upper die assembly, and defining cutting edges 90 utilized to sever link 66 during or after termination in a single procedure.

Inserts 22 comprise round cylindrical members of low resistance copper, preferably, having diameters just smaller than the diameters of holes 60 and apertures 68, so that they are easily insertable thereinto. Inserts 22 have a length larger than the combined thicknesses of adapter section 20, cable 12, and upper and lower support members 24,26. In FIG. 5 assembly 64 on transfer plate 70 has been moved forwardly so that holes 60, apertures 68 and inserts 22 therethrough are disposed over lower punches 76 of die block 72, and link 66 is disposed over cavity 88. Upon being moved over passageways 78 of die block 72, inserts 22 drop incrementally to rest atop lower punches 76, and end portions of inserts 22 extend slightly below and above the lower and upper surfaces of the stacked assembly 64 (see FIG. 7A).

FIGS. 6 through 8 show the upper and lower die assemblies of apparatus 80 and illustrate the termination procedure. Lower die assembly 100 includes a support block 102, die block 72, lower punches 76 disposed in respective passageways 78 in die block 72 and anchored in a camming plate 104 which is resting on surface 106 of support block 102, first compression spring elements 108 between die block 72 and camming plate 104, vertical cams 110 and horizontal cams 112. Upper die assembly 120 includes punch plate 122, upper coining punches 124 anchored to punch plate 122 and disposed in respective passageways 126 of pressure pad 128 and precisely aligned with respective lower punches 76, vertical blocks 130 mounted to sides of punch plate 122 and in alignment with vertical cams 110 of lower die assembly 100, and socket head shoulder screws 132 through spring elements 134 securing pressure pad 128 beneath punch plate 122.

In FIG. 6 upper and lower die assemblies 120,100 are shown spaced vertically apart, with a stacked assembly 64 to be terminated shown resting on die block 72 and positioned by transfer plate 70 properly in punch region 74, with inserts 22 atop respective lower punches 76 and below respective upper punches 124.

In FIG. 7 upper die assembly !20 is shown partially through its stroke downward toward lower die assembly 100. Pressure pad 128 has already engaged top surface portions of assembly 64 and has been stopped thereby, being moved relatively upwardly toward punch plate 122 and compressing spring elements !34. Upper punches 124 have relatively moved downwardly within respective passageways 126 toward and engaging top surfaces of respective inserts 22. Stacked assembly 64 is now clamped between portions of bottom surface 136 of pressure plate 128 and top surface 84 of die block 72, under pressure resulting from second compression spring elements 134. Bottom surfaces 138 of vertical blocks 130 have just engaged top surfaces 140 of vertical cams !!0 to initiate the second stage of the stroke. Stacked package 64 will continue to be clamped between pressure plate 128 and die block 72 during the cycle until the upper punches 124 make contact with the top insert surfaces 146.

As seen in FIG. 7A which is an enlarged view of an insert region of stacked package 64, stacked package 64 is clamped between lower surface 136 of pressure pad 128 and top surface 84 of die block 72. Insert 22 includes end portions 142,144 extending above and below top and bottom surfaces of stacked package 64 equal small amounts d . A staking boss 146 of an upper punch !24 has just engaged the top surface 148 of insert 22, while bottom surface 150 of insert 22 is atop a staking boss 152 of a lower punch 76. Annular recesses 154,156 surround upper and lower staking bosses 146,152 respectively, and have curved recess bottoms.

In FIG. 8 upper die assembly 120 has completed its downward stroke. Vertical blocks 130 have urged vertical cams 110 downwardly; cam surfaces 160 of vertical cams 110 having a 45° angle have transmitted the downward force against first cam surfaces 162 of horizontal cams 112 also having an angle of 45° , vertical cams 110 being supported an incremental distance above surface 106 of support block 102 by first cam surfaces 162 of horizontal cams 112; downward forced movements of vertical cams 110 have urged horizontal cams 112 relatively toward each other an incremental distance; second cam surfaces 164 of horizontal cams 112 having an angle of 45° have transmitted the horizontal force against cam surfaces 166 of camming plate 104 having angles of 45° . The horizontal forces transmitted to camming plate 104 have urged it incrementally upwardly, thereby moving lower punches 76 upwardly a corresponding incremental amount.

It is highly desirable that inserts 22 receive an equal force from top and bottom from upper and lower coining punches 124,76. To this end it is desirable to position inserts 22 within aligned holes 60,68 so that equal end portions protrude above and below the package at the moment they are struck by upper and lower punches, and it is desirable that upper and lower punches are in motion to strike the inserts simultaneously from above and below. This is brought about, with reference to FIG. 6, by constructing the apparatus 80 with consideration for the length of inserts 22 so that both the distance between the bottom surfaces 138 of vertical blocks 130 and the top surfaces 140 of vertical cams 110 and the distance between top insert surfaces 148 and upper staking bosses 146 are equal distances at a single point in time, represented by D . Thus the bottoms of vertical blocks 130 will engage the tops of vertical cams 110 at the same instant the upper staking bosses 146 engage the top surfaces 148 of inserts 22. The apparatus 80 may be designed for example that the stroke of the press is set to bottom at 0.025 inches below the level at which vertical blocks 130 engage vertical cams 110, and the lower coining punches 76 will move an identical 0.025 inches upwardly as a result of the camming action of the apparatus.

FIG. 8A illustrates the result of simultaneous coining of upper and lower end portions 142,144 of an insert 22 by upper and lower staking bosses 146,152 respectively. Upper end portion 142 has been deformed by staking boss 146 radially outwardly, to define an enlarged head 170 peripherally around hole 60 of upper support member 24 by reason of a roll-over action caused by the curved bottom of annular recess 154 around staking boss 146. Likewise lower end portion 144 has been deformed into an enlarged head 172 peripherally around hole 60 of lower support member 26 by reason of the curved bottom of annular recess 156 around lower staking boss 152. Insert 2 has thus been deformed to create a sound mechanical joint holding the stacked package together. More importantly, the staking operation has expanded the diameter of central shank portion 174 of the insert radially outwardly against the sides of holes 60 and aperture 68 resulting in a gas-tight connection at annular region 176 with conductor 14 of cable 12 and at annular region 178 with adapter section 20. The insert after staking defines an assured electrical connection between conductor 14 of cable 12 and adapter section 20, as well as an assured mechanical connection thereof.

Upon completion of the termination, springs 108 force camming plate 104 down which pulls lower punches 76 from inserts 22, and springs 134 force pressure plate 128 down which strips now-staked stacked assembly 64 from upper punches 124, enabling removal of assembly 64 from the apparatus. At the same time camming plate 104 pushes horizontal cams 112 laterally outwardly, and they in turn push vertical cams 110 vertically upwardly to complete the cycle.

FIG. 9 shows the cross-section through a completed termination 180 having four staked inserts 182 mechanically and electrically joining the two conductors 4 of cable 12 to respective adapter sections 20. Adapter sections 20 are spaced from each other at gap 184, and are now separate entities by reason of link 66 having been severed from between them during termination; adapter sections 20 are therefore now insulated from each other, defining separate power transmitting devices terminated to respective conductors 14 of cable 12.

FIG. 10 shows a continuous strip 186 of adapter sections 20 joined in pairs by links 66, with the pairs joined by carrier strip portions 188, for easy handling from the stamping die through reeling, unreeling, plating, reeling and delivery to the termination area.

FIG. 11 illustrates a contact section 40 of an adapter section 20, and upwardly and downwardly angled splines 44,42. Central regions 46 of contact sections 40 containing upwardly angled splines 44 are shown offset upwardly a slight amount from the plane of the adapter section, so that the lower surface of central region 46 is coplanar with the upper surfaces of the regions on both sides defining a mating surface in one plane with appropriate lead-in surfaces at the splines 42,44 for initiating the engagement with free ends of the spring arms of the mating terminals (FIG. 1). After mating this offset results in a minimized height of the mated adapter sections and terminals by deflecting the corresponding spring arms 38 of terminals 28 downwardly from a slight upward offset, in which case the free ends of the spring arms of the terminals are generally coplanar with the free ends of the adjacent downwardly angled splines of the adapter sections. The principle is disclosed in U.S. patent application Ser. No. 07/233,684 filed Aug. 18, 1988 and assigned to the assignee hereof. The contact sections may also be blade-like tabs for being secured to terminal posts of conventional power supplies.

Shown in FIGS. 13 through 18 are variations of the present termination technique for splicing two dual conductor flat cables together, or tapping a branch cable from a main cable, all using the prepunching of holes in the cable, support members, and low resistance copper inserts which are staked. In FIGS. 13 and 14, a tap cable 200 is prepared to be terminated to a main cable 202 by severing a pair of support members 204 and punching pairs of holes 206 in the tap cable end section 208, the support members 204, and a tap region 210 of main cable 202; then inserts 212 are inserted into the stacked assembly thereof and staked, as in FIGS. 6 to 8, with no need of adapter members, and defining a parallel or in-line tap termination 214.

In FIGS. 15 and 16 a splice termination 300 is shown which splices end portions of two cables 302 together, where rectangular support members 304 are cut from one of the cables. Two arrays of pairs of holes 306 are punched in the two cable end portions and in the rectangular support members, with inserts 308 inserted into all aligned holes and staked as before. Greater mechanical strength is believed obtained to resist stress by using two rows of staked inserts, as well as redundant electrical connection. One row of staked inserts could also be used, as in the parallel tap termination of FIG. 14. Conversely, a parallel tap as in FIG. 14 could also be created with two rows of staked inserts.

FIGS. 17 and 18 illustrate another kind of tap termination 400, wherein a tap cable 402 extends laterally from main cable 404 to define a 90° tap. Since the conductors 406,408 of tap cable 402 are to be interconnected with one of conductors 410,412 of main cable 404 and must cross over but remain insulated from the other thereof, the pairs of holes must be staggered with respect to both cables 402,404. The pair of holes 414 is oriented transverse with respect to conductor 410 of main cable 404 and axially with respect to conductor 408 of tap cable 402 and rectangular support members 416; similarly, the pair of holes 418 is oriented transverse with respect to conductor 412 of main cable 404 and axially with respect to conductor 406 of tap cable 402 and rectangular support members 416. The center points between the pairs of holes comprise corners of a square, in order for the pairs to result in alignment after stacking the main and tap cables and the support members, with the center points staggered a distance C preferably equal to the distance between the centerlines of the conductors of the main and tap cables, which in the present embodiment are identical types of cable. Inserts 420 are placed in the vertically aligned holes of the stacked assembly 416,402,404,416 and then staked as before.

The present termination technique can be utilized to terminate a pair of contact terminals to the end of a dual (or single) conductor flat power cable, to provide an assured gas-tight electrical connection and strong mechanical joint therewith, and can also be used to splice two cables together and to terminate a tap cable to a main cable. The use of support members is preferred although in some instances may be omitted, it is believed, and still obtain a satisfactory electrical and mechanical termination. Other variations and modifications may be made which are within the spirit of the invention and the scope of the claims.

What is claimed is:

1. A termination of an electrical terminal to an end of a flat power cable having at least one flat conductor member, comprising:

an end section of a flat power cable having at least one flat conductor member therein, said end section including a plurality of holes punched therethrough of selected diameter at selected locations;

metal terminal means having plate section means and contact section means extending forwardly from said plate section means, said plate section means coextending with said cable end section and adjacent thereto and including a like plurality of apertures therethrough corresponding to said punched cable holes and having like diameters and aligned therewith; and cylindrical insert members extending through said aligned punched cable holes and terminal apertures, said insert members being of low resistance metal and having end sections protruding outwardly from outwardly facing surfaces of said terminal plate section means and said cable end section, said insert end sections having been staked to enlarge said protruding insert end sections defining respective mechanical joints joining said terminal means to said cable end section, and to enlarge the diameters of said insert members within said holes and apertures to tightly engage edge surfaces of said at least one cable conductor and said terminal plate section means thereat defining gas-tight electrical connections between said insert members and said at least one cable conductor and said terminal means.

2. A termination as set forth in claim 1 wherein said terminal means comprises a pair of members each having a respective plate section and a respective contact section.

3. A termination as set forth in claim 2 wherein said cable includes a pair of conductor members, and a said terminal member is associated with each said conductor member and is joined thereto by at least a pair of said insert members extending through a pair of terminal apertures and a corresponding pair of punched cable holes and staked.

4. A termination as set forth in claim 1 wherein said cable is a single conductor cable, and said terminal means joined thereto by at least a pair of said insert members extending through a pair of terminal apertures and a corresponding pair of punched cable holes and staked.

5. A termination as set forth in claim 4 wherein said terminal means comprises a pair of sections joined together at a linking section, each having a respective plate section and a respective contact section, and each said plate section is joined to said cable by at least a pair of said insert members extending through a pair of terminal apertures and a corresponding pair of punched cable holes and staked.

6. A termination as set forth in claim 1 wherein said contact section comprises a plurality of upwardly facing contact mating surfaces matable with spring arms of a mating contact means of another electrical article, and a plurality of downwardly facing surfaces matable with other spring arms of the mating contact means of the other electrical article.

7. A termination as sect forth in claim 6 wherein one of said upwardly facing and downwardly facing contact mating surfaces is disposed on a portion of said contact section offset vertically from remaining portions of said contact section, whereby said upwardly and downwardly facing contact mating surfaces are defined on a common mating plane.

8. A termination as set forth in claim 1 further comprising upper and lower support members respectively disposed along and against the upwardly facing surface of one of said terminal means and said cable end section and the downwardly facing surface of the other of said terminal means and said cable end section, each of said support members having a like plurality of holes punched therethrough dimensioned and located to correspond with said punched cable holes and terminal apertures, whereagainst said insert end sections are staked forming said mechanical joints.

9. A termination as set forth in claim 8 wherein said upper and lower support members comprise severed strips of flat cable at least similar to said flat cable.

10. A method of terminating flat power cable having at least one flat conductor member with a terminal means for connecting the flat power cable to an electrical article, comprising the steps of:

preparing an end section of said flat cable by punching therethrough a plurality of holes of selected diameter arrayed transversely thereacross proximate an end edge of said flat cable, exposing sheared edges of said at least one conductor defining walls of said holes;

selecting a terminal means having a plate section and a contact section means, said plate section means including a like plurality of apertures therethrough having vertical side walls and having diameters substantially equal to said punched cable holes and identically arrayed with respect thereto, said contact section extending outwardly from said plate section means;

placing said terminal plate section means parallel to and adjacent a major surface of said cable end section with said terminal apertures aligned with said punched cable holes defining insert-receiving hole arrangements, with said contact section means extending outwardly from said cable end section;

inserting into each said insert-receiving hole arrangement a conductive insert member of low resistance having a diameter slightly less than the diameters of said terminal aperture and said punched cable hole and having a length longer than the thicknesses of said plate section means and said cable so that end sections of said insert can protrude outwardly from the outwardly facing surfaces of said terminal means and said cable end section at said hole arrangement, defining a stacked package;

placing said stacked package in a punch region of a reciprocating ram press terminating apparatus and between upper and lower die assemblies thereof, said upper die assembly including a like plurality of upper coining punches and said lower die assembly including a like plurality of lower coining punches associated with said upper coining punches defining pairs of punches located across said punch region to correspond with said insert members of said stacked package disposed therebetween, all such that said insert end sections protrude outwardly from said stacked package; and staking said protruding end sections of said insert members with said upper and lower coining punches simultaneously, thereby enlarging said protruding insert end sections forming heads radially outwardly along and against said outwardly facing surfaces of said terminal means and said cable end section at said hole arrangements, and enlarging said diameters of said insert members within said hole arrangements tightly against said sheared conductor edges and vertical aperture side walls and forming gas-tight electrical connections therewith interconnecting said cable conductor and said terminal means, whereby said terminal means is terminated to said flat power cable.

11. A method of terminating as set forth in claim 10 further comprising the steps, prior to said placement of said stacked package into said apparatus, of selecting and disposing upper and lower support members along said outwardly facing surfaces of said terminal means and said cable end section, wherein said insert members have lengths exceeding the combined thicknesses of said cable end section, said plate section means and said upper and lower support members, said upper and lower support members having a like plurality holes therethrough having diameters substantially the same as said punched cable holes and alignable therewith, and said insert end sections protrude outwardly from outwardly facing surfaces of said upper and lower support members after placement in said apparatus.

12. A method of termination as set forth in claim 11 wherein said step of selecting said upper and lower support members comprises the step of severing strips of said flat power cable from said end section and punching holes therethrough, and said cable holes are punched therethrough after said severing.

13. A method of terminating as set forth in claim !0 wherein said punched cable holes, said terminal apertures and said insert members are cylindrical.

14. A method of terminating as set forth in claim 10 wherein said flat power cable comprises a pair of spaced apart flat conductors therein and said terminal means comprises a pair of adapter sections joined by a severable linking section and each having a plate section and a contact section, further including the step of severing said severable linking section upon termination, defining separate terminations of said pair of flat conductors.

15. An interconnection of conductor means of two flat power cables, comprising:

a stack of selected sections of first and second flat cables one atop the other having respective arrays of holes punched therethrough, the holes of one thereof being vertically aligned with the holes of the other defining pairs of aligned holes; and insert members of low resistance copper disposed within respective said pairs of aligned holes and having end sections protruding outwardly from outwardly facing surfaces of said first and second flat cables, said insert end sections having been staked to enlarge said protruding insert end sections defining respective mechanical joints joining said selected cable sections, and to enlarge the diameters of said insert members within said pairs of aligned holes to tightly engage edge surfaces of the conductor means of said first and second flat cables defining gas-tight electrical connections between said insert members and said conductor means of said first and second flat cables.

16. An interconnection as set forth in claim 15 wherein said first and second flat cables are single conductor cables.

17. An interconnection as set forth in claim 15 wherein said first and second flat cables are dual conductor cables.

18. An interconnection as set forth in claim 15 further comprising upper and lower support members respectively disposed along and against the upwardly facing surface of the upper one of said first and second flat cables and the downwardly facing surface of the other thereof, each of said support members having a like array of holes punched therethrough dimensioned and located to correspond with said pairs of aligned holes, whereagainst said insert end sections are staked forming said mechanical joints.

19. An interconnection as set forth in claim 18 wherein said upper and lower support members comprise severed strips of flat cable at least similar to said first and second flat cables.

20. An interconnection as set forth in claim 15 wherein one of said first and second flat cables is a main cable and the other thereof is a tap cable.

21. An interconnection as set forth in claim 20 wherein said tap cable is oriented parallel to said main cable.

22. An interconnection as set forth in claim 20 wherein said tap cable extends perpendicularly from said main cable and in a parallel plane, defining a T-tap.

23. An interconnection as set forth in claim 22 wherein said first and second flat cables each include first and second conductors, said arrays of holes comprise first and second sets of holes, and central locations of said first and second sets of holes are staggered axially and transversely with respect to both said cables so that the axial and transverse distances each are about equal to the distance between the centerlines of said first and second conductors of said first and second flat cables, whereby said first set of holes extend through said first conductors and said second set of holes extend through said second conductors.

24. A method of interconnecting two flat power cables each having a respective at least one flat conductor therein, comprising the steps of:

preparing a selected section of a first said flat cable by punching therethrough a plurality of first holes of selected diameter arrayed transversely thereacross and exposing sheared edges of said at least one conductor defining walls of said first holes;

preparing a selected section of a second said flat cable by punching therethrough a like plurality of second holes of like diameter identically arrayed transversely thereacross and exposing sheared edges of said at least one conductor defining walls of said second holes;

placing said second cable selected section parallel to and adjacent a major surface of said first cable selected section with said second holes aligned with said first holes defining insert-receiving hole arrangements;

inserting into each said insert-receiving hole arrangement a conductive insert member of low resistance having a diameter slightly less than the diameters of said first and second holes and having a length longer than the thicknesses of said first and second cables so that end sections of said insert can protrude outwardly from the outwardly facing surfaces of said first and second selected sections at said hole arrangement, defining a stacked package;

placing said stacked package in a punch region of a reciprocating ram press terminating apparatus and between upper and lower die assemblies thereof, said upper die assembly including a like plurality of upper coining punches and said lower die assembly including a like plurality of lower coining punches associated with said upper coining punches defining pairs of punches located across said punch region to correspond with said insert members of said stacked package disposed therebetween, all such that said insert end sections protrude outwardly from said stacked package; and staking said protruding end sections of said insert members with said upper and lower coining punches simultaneously, thereby enlarging said protruding insert end sections forming heads radially outwardly along and against said outwardly facing surfaces of said first and second selected sections at said hole arrangements, and enlarging said diameters of said insert members within said hole arrangements tightly against said sheared conductor edges and forming gas-tight electrical connections therewith interconnecting said at least one conductor of said first cable and said at least one conductor of said second cable, whereby said first and second cables are interconnected.

25. A method of terminating as set forth in claim 24 further comprising the steps, prior to said placement of said stacked package into said apparatus, of selecting and disposing upper and lower support members along said outwardly facing surfaces of said first and second selected sections, wherein said insert members have lengths exceeding the combined thicknesses of said first and second cables and said upper and lower support members, said upper and lower support members having a like plurality holes therethrough having diameters substantially the same as said punched cable holes and alignable therewith, and said insert end sections protrude outwardly from outwardly facing surfaces of said upper and lower support members after placement in said apparatus.

26. A method of termination as set forth in claim 25 wherein said step of selecting said upper and lower support members comprises the step of severing strips of cable from a flat power cable similar to said first and second cables, said strips having a width axially at least about equal to twice the said selected diameter of a said first and second hole, and punching holes therethrough.

27. A method of terminating as set forth in claim 24 wherein said first and second holes and said insert members are cylindrical.

28. A method of terminating as set forth in claim 24 wherein said first and second flat power cables comprise pairs of spaced apart first and second flat conductors therein and said plurality of first holes includes a first set of at least two holes punched through said first conductors of said first cable and said second cable, and a second set of at least two holes punched through said second conductors of said first and second cables, whereby said first and second conductors of said first cable is interconnected to the corresponding said first and second conductors of said second cable.

29. A method of interconnecting as set forth in claim 28 wherein one of said first and second cables is a main cable and the other thereof is a tap cable, and said selected section of said tap cable is an end section.

30. A method of interconnecting as set forth in claim 29 wherein said tap cable is oriented parallel to said main cable.

31. A method of interconnecting as set forth in claim 29 wherein said tap cable extends perpendicularly from said main cable and in a parallel plane, defining a T-tap.

32. A method of interconnecting as set forth in claim 31 wherein central locations of said first and second sets of holes are staggered axially and transversely with respect to both said cables so that the axial and transverse distances each are about equal to the distance between the centerlines of said first and second conductors of said first cable and said second cable.

33. A method of interconnecting as set forth in claim 24 wherein one of said first and second cables is a main cable and the other thereof is a tap cable, and said selected section of said tap cable is an end section.

34. A method of interconnecting as set forth in claim 33 wherein said tap cable is oriented parallel to said main cable.

35. A method of interconnecting as set forth in claim 33 wherein said tap cable extends perpendicularly from said main cable and in a parallel plane, defining a T-tap.

36. Apparatus for either terminating a terminal to a flat power cable or interconnecting a pair of flat power cables, comprising:

reciprocating ram press means having an upper die assembly reciprocally movable with respect to a lower die assembly;

said upper die assembly including an array of upper punch members secured to and depending vertically beneath a ram portion of the apparatus, a pressure plate secured below said ram portion and including passageways through which extend respective said upper punch members, and vertical block members disposed on sides of said upper punch member array;

said lower die assembly including an array of lower punch members secured to and extending vertically upwardly from a camming block disposed along a top surface of a support block and vertically movable upwardly from said support block, said lower punch members respectively associated with said upper punch members in punch pairs and precisely aligned therewith, a die block fixedly secured in said lower die assembly secured above said camming block and including passageways through which extend respective said lower punch members, vertical cam members spaced laterally from ends of said camming block and associated with and vertically aligned with said vertical block members of said upper die assembly and vertically movable within said lower die assembly, and horizontal cam members associated with said vertical cam members and respective ends of said camming block and movable along said top surface of said support block toward and away from said camming block;

said vertical cam members having lower ends having 45° angled surfaces engaged and slidably movable along cooperating 45° angled surfaces of outer ends of said horizontal cam members, and inner ends of said horizontal cam members having 45° angled surfaces engaged and slidably movable along cooperating 45° angled surfaces of said respective ends of said camming block, all so that upon said vertical cam members being struck by said vertical blocks during the downward stroke of said upper die assembly said force is transmitted to said outer ends of said horizontal cam members to move them inwardly and against respective said ends of said camming block and thereby moving said camming block upwardly, whereby said pairs of upper and lower punch members are urged simultaneously against respective metal insert members disposed in respective hole arrangements through either a stacked package of at least a terminal means and a flat cable or a stacked package of at least two flat cables with insert ends protruding above and below said stacked package, which stacked package is placed in said punch region between said upper and lower die assemblies prior to actuation of the apparatus, to stake said protruding insert ends simultaneously to either terminate said terminal to said flat cable or to interconnect conductors of said two flat cables.

37. An apparatus as set forth in claim 36 wherein a first compression spring means is disposed between said die block and said camming block whereby said camming block compresses said first compression spring means during said upward movement during said downward stroke of said upper die assembly, and said camming block is returnable to a rest position atop said support block by said first compression spring means, and said horizontal cam members are returned outwardly by said camming block and said vertical cam members are returned upwardly by said horizontal cam members, during an upward recovery stroke after said termination or interconnection.

38. An apparatus as set forth in claim 36 wherein a second compression spring means is disposed between said pressure plate and said ram portion whereby said pressure plate engages top surface portions of a said stacked package during said downward stroke prior to said pairs of punches striking said inserts and clamps said stacked package around said inserts, and said pressure plate is movable upwardly against said second compression spring means during the remainder of said downward stroke, and is returnable to a rest position by said second compression spring means during an upward recovery stroke after said termination or interconnection.

39. An apparatus as set forth in claim 36 wherein said punches each include a staking boss centrally disposed within an annular recess to enlarge a said insert end portion upon striking during termination or interconnection.

40. An apparatus as set forth in claim 36 wherein said inserts of a said stacked package rest atop upper ends of respective said lower punches prior to actuation of the apparatus, and lower ends of respective said upper punches are precisely disposed a distance above upper ends of said inserts equal to the distance between the bottom surface of said vertical blocks of said upper die assembly and top surfaces of said vertical cam members of said lower die assembly.

41. An apparatus as set forth in claim 36 further including a transfer plate movable in a predetermined path horizontally across said die block of said lower die assembly, said transfer plate including a nest wherein said stacked package is able to be assembled and said nest containing a said stacked package is movable into said punch region for said stacked package to be disposed between said upper and lower punch arrays prior to actuation of said apparatus.

42. An apparatus as set forth in claim 36 further including an additional die means for severing a severable link between portions of a terminal means of a stacked package for terminating a flat cable where said flat cable has two conductors to define separate terminal members of the resultant termination.

* * * * *